US005498203A

United States Patent [19]

Reichert

[11] Patent Number: 5,498,203

[45] Date of Patent: Mar. 12, 1996

[54] MANUALLY ADJUSTABLE FORCED AIR-FLOW DEFLECTOR

[76] Inventor: Gottfried Reichert, 1155 Grey Owl Point, Mississauga, Ontario, Canada, L4Y 2W3

[21] Appl. No.: 421,978

[22] Filed: Apr. 14, 1995

[51] Int. Cl.[6] ..... F24F 13/06

[52] U.S. Cl. ..... 454/289; 454/307

[58] Field of Search ..... 454/284, 289, 454/290, 306, 307, 309, 311

[56] References Cited

U.S. PATENT DOCUMENTS

| | | | |
|---|---|---|---|
| 1,276,063 | 8/1918 | Hood | 454/327 |
| 2,315,154 | 3/1943 | Fenner | 454/284 |
| 3,354,808 | 11/1967 | Macrow | 454/290 |
| 5,033,362 | 7/1991 | Huckestein . | |
| 5,194,043 | 3/1993 | Takahashi et al. | 454/316 |
| 5,232,403 | 8/1993 | Marotta | 454/289 |

FOREIGN PATENT DOCUMENTS 2031728 11/1993 Canada .

2096614 11/1993 Canada .

*Primary Examiner*—Harold Joyce
*Attorney, Agent, or Firm*—Donald E. Hewson

[57] ABSTRACT

A manually adjustable forced air-flow deflector for use on a register of a forced air heating system. The forced air-flow deflector comprises a back plate having a first end and a second end, with the first and second end plates secured to the respective first and second end of the back plate so as to project forwardly in generally transverse relation with respect to the back plate. The forced air-flow deflector further comprises a movable air-flow guiding plate and retaining means therefor. The movable air-flow guiding plate is retained in selectively movable relation by a retaining means comprising a first, second and third pairs of directly opposed grooves disposed one in each of the end plates. The first pair of grooves retains the air-flow guiding plate in generally upstanding relation at the front of the end plates. The second pair of grooves retains the air-flow guiding plate at a central portion of the end plates in angled relation, upwardly directed away from the back plate. The third pair of grooves retains the air-flow guiding plate in generally horizontal relation at the top of the end plates.

10 Claims, 2 Drawing Sheets

MANUALLY ADJUSTABLE FORCED AIR-FLOW DEFLECTOR

FIELD OF THE INVENTION

This invention relates to manually adjustable forced air-flow deflectors, which may guide warm or cool forced air emanating from a floor register in a building.

BACKGROUND OF THE INVENTION

It is common for such air-flow deflectors which are located on the top of a floor register in a building to have only one air-flow direction. Air-flow deflectors of this type are uneconomical and inconvenient because warm and cool forced air are both used in a building. The warm forced air-flow should be directed in a more horizontal direction because warm air is light and flows upwardly by itself. The cool forced air should be directed in the upward direction, because cool air is heavy and settles down by itself. Therefore, where warm and cool forced air are both used in a building, two types of air-flow deflectors are required to direct the air properly in order to hear or cool economically and thus save money. Having two forced air-flow deflectors for each floor register in a building would be uneconomical and inconvenient. First, in these types of air-flow deflectors, the air-flow direction is not adjustable. Secondly, the cost for a second air-flow deflector for each floor register or air outlet in a building is not economical. Thirdly, the required storage space for that type of air-flow deflector, which is not in use at the time, is inconvenient.

I have found that these mentioned disadvantages may be overcome by providing only one very simple in structure and affordable, manually adjustable air-flow deflector, which may guide warm or cool forced air in three different, economical air-flow directions from a floor register or other forced air outlet in a building. One direction is horizontal, for a warm forced air-flow direction; one is upward, for a cool forced air-flow direction; and one is between the warm or cool air-flow directions, which is sometimes required to correct a wasted or an uneconomical and inconvenient air-flow direction. In this device, the air-flow guiding plate is manually adjustable and may guide warm or cool forced air in the required economical and convenient air-flow direction. The upwardly and forwardly slanted back plate of this adjustable air-flow deflector may prevent an unwanted air-flow to curtains or windows. This air-flow deflector may be manufactured from suitable plastic or other suitable material. Because of the very simple structure, the cost of this air-flow deflector should be very low and affordable, thus saving users a substantial amount of money. Because the direction of air-flow is controllable by means of placement of the air-flow guiding plate within the air-flow deflector, this air-flow deflector may be permanently connected with fasteners to the floor or floor register, but is preferably connected by means of magnets so as to be removable.

SUMMARY OF THE INVENTION

In accordance with one aspect of the present invention, there is provided a manually adjustable forced air-flow deflector comprising a back plate having a first end and a second end, with first and second end plates secured to the respective first and second end of the back plate so as to project forwardly in generally transverse relation with respect to the back plate, and a movable air-flow guiding plate and retaining means therefor. The movable air-flow guiding plate is retained in selectively movable relation by a retaining means for movement between a first distinct position whereat the air-flow guiding plate is oriented in generally upstanding relation at the front of the end plates, a second distinct position whereat the air-flow guiding plate is oriented in angled relation, upwardly directed away from the back plate at a central portion of the end plates, and a third distinct position whereat the air-flow guiding plate is oriented in generally horizontal relation at the top of the end plates.

DETAILED DESCRIPTION OF THE PREFERRED EMBODIMENTS

Figure 3:
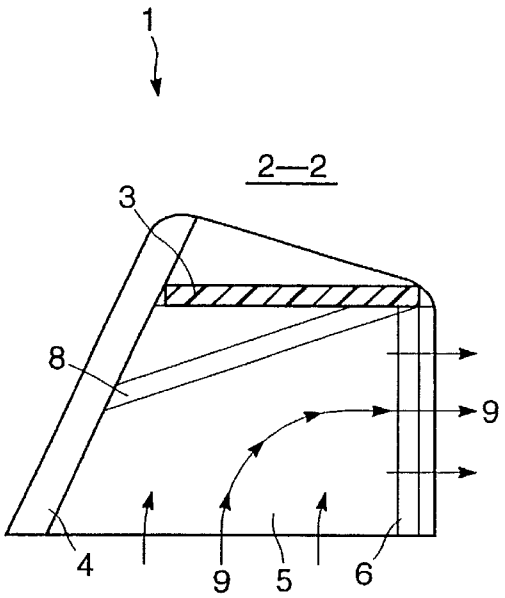
FIG. 3 is a sectional end view of the embodiment shown in FIG. 1, along section line of the embodiment 2—2, showing the right inside end plate and showing the air-flow guiding plate oriented in a warm air-flow position.
Figure 1:
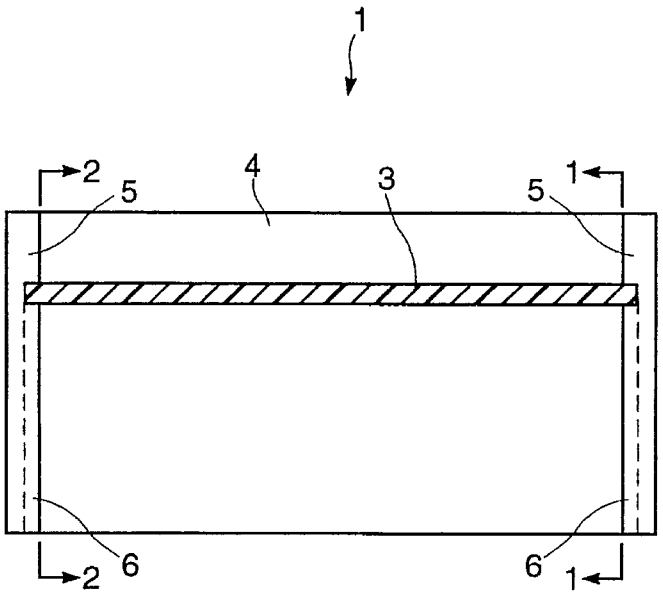
FIG. 1 is a front view of the preferred embodiment, showing the end plates and the air-flow guiding plate in a warm forced air-flow position.
Figure 2:
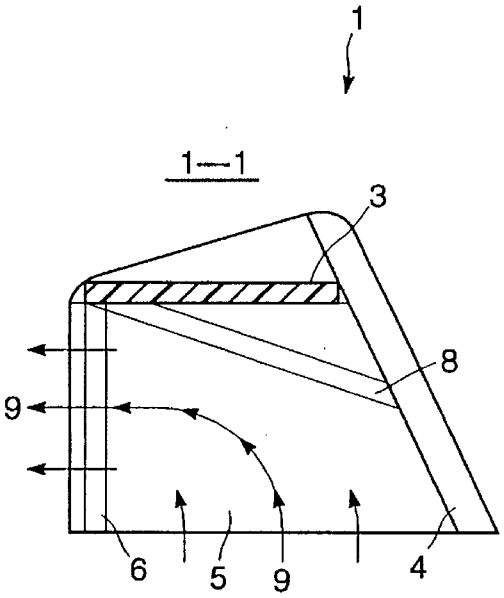
FIG. 2 is a sectional end view of the embodiment shown in FIG. 1, along section line 1—1, showing the left inside end plate and showing the air-flow guiding late oriented in a warm air flow position.
Figure 7:
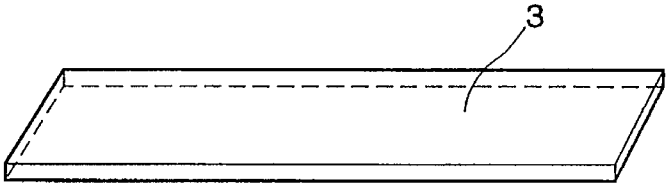
FIG. 7 shows the air-flow guiding plate in a warm air-flow position.
Figure 6:
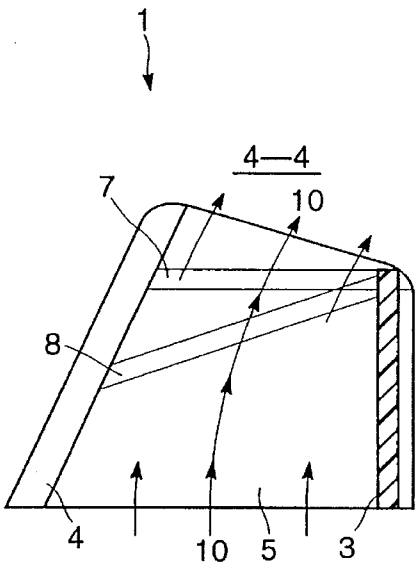
FIG. 6 is a sectional end view of the embodiment shown in FIG. 1, along section line 4—4, showing the right inside end plate and air-flow guiding plate in a cool air flow position.
Figure 4:
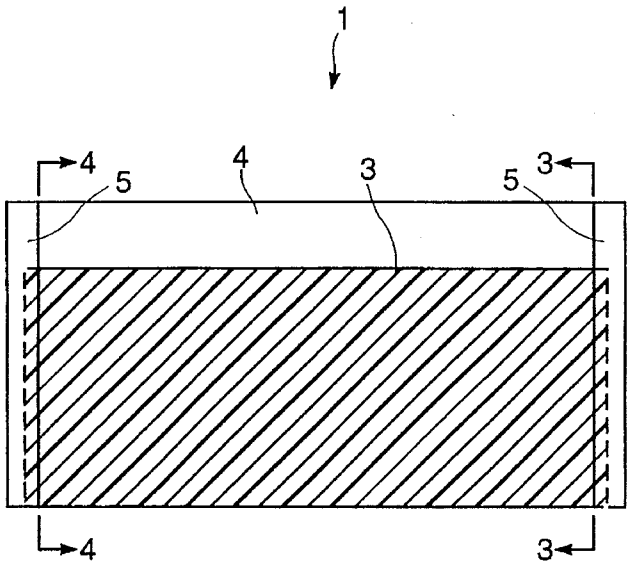
FIG. 4 is a front view of the embodiment shown in FIG. 1, showing the end plates and the air-flow guiding plate in a cool air-flow position.
Figure 5:
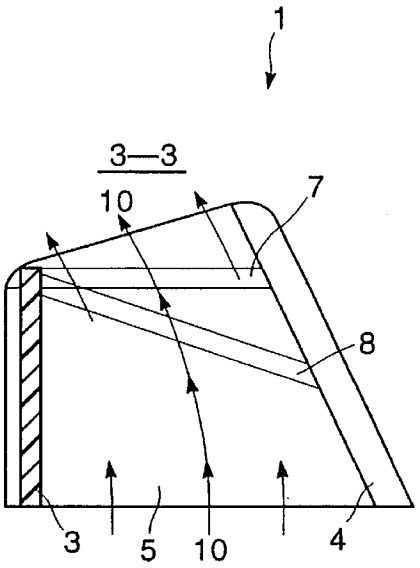
FIG. 5 is a sectional end view of the embodiment shown in FIG. 1, along section line 3—3, showing the left inside end plate with the air-flow guiding plate in a cool air-flow position.
Figure 8:
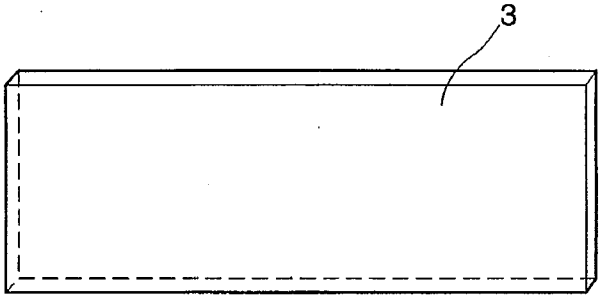
FIG. 8 shows the air-flow guiding plate in a cool air-flow position.

Reference will now be made to FIGS. 1 through 8, which show the manually adjustable forced air-flow deflector 1 of the present invention. The manually adjustable forced air-flow deflector 1 comprises a back plate 4 having a first end and a second end and is slanted upwardly and forwardly. In the preferred embodiment, the back plate 4 leans forwardly at an angle of about 65°.

First and second vertically oriented end plates 5 are secured to the respective first and second ends of the back plate 4 so as to form a solid body. The end plates 5 project forwardly therefrom in generally transverse relation with respect to the back plate 4.

A moveable air-flow guiding plate 3 is retained by a retaining means, as will be detailed subsequently, in selectively moveable relation by the retaining means for movement between a first distinct position, whereat the air-flow guiding plate 3 is oriented in generally upstanding relation, preferably generally vertically, at the front of the end plates, a second distinct position whereat the air-flow guiding plate 3 is oriented in angled relation, upwardly directed away from the back plate 4 at a central portion of the end plates, and a third distinct position whereat the air-flow guiding plate 3 is oriented in generally horizontal relation at the top of the end plates.

In the preferred embodiment, the retaining means comprises a first pair of directly opposed grooves 6, which grooves 6 are oriented in generally upstanding relation, preferably disposed in generally vertically oriented relation. Each groove of the first pair of grooves 6 is shaped and dimensioned to receive and retain one end of the air-flow guiding plate in each groove such that the air-flow guiding plate is disposed in generally upstanding relation.

The retaining means further comprises a second pair of directly opposed grooves 8 disposed one in each of the end plates 5 at a central portion thereof in angled relation, upwardly directed away from the back plate 4. Each groove of the second pair of grooves 8 is oriented at a central portion of the respective end plate in angled relation, and is shaped and dimensioned to receive and retain one end of the air-flow guide plate therein such that the air-flow guiding plate 3 is disposed at a central portion thereof in angled relation, upwardly directed away from the back plate 4. In the preferred embodiment, the air-flow guiding plate 3 contacts the back plate 4 when the air-flow guiding plate 3 is in place in either of the second pair of directly opposed grooves or the third pair of directly opposed grooves.

Also, the retaining means further comprises a third pair of directly opposed grooves 7 disposed one in each of the end plates at the top thereof in generally horizontal relation. Each groove of the third pair of grooves 7 in oriented in generally horizontally oriented relation and is shaped and dimensioned to receive and retain one end of the air-flow guiding plate 3 therein, in generally horizontally oriented relation.

In the preferred embodiment, the grooves of each of the first pair of grooves 6, the second pair of grooves 8, and the third pair of grooves 7, are square in cross-section so as to properly receive the squared end edges of the moveable air-flow guiding plate 3.

In the preferred embodiment, the first pair of grooves 6, the second pair of grooves 8, and the third pair of grooves 7, are recessed in the end plates 5. Alternatively, the grooves may be formed by ribs projecting outwardly from the side plates 5.

In the preferred embodiment, the forced air-flow deflector 1 is connected to a forced air-flow register by means of magnets, so as to be easily placeable and also subsequently removable. If desired, the forced air-flor deflector 1 may be mounted to the floor by way of fasteners, so as to preclude ready removal or movement. The forced air-flow deflector 1 is preferably made from clear plastic material so as to be visually unobtrusive and so as to be low cost.

It is contemplated that, in an alternative embodiment, the retaining means for the moveable air-flow guiding plate 3 could comprise a pair of bracket members secured to the back plate 4, thus precluding the need to provide grooves in the side plates 5.

In use, the air-flow deflector 1 of the present invention may be used to deflect air from a forced air register in any one of three different flow directions. As can best be seen in FIGS. 1 through 3, when the air-flow guiding plate 3 is in the third pair of grooves 7, air flows outwardly from the forced air-flow deflector 1 at the front thereof, as indicated by arrows 9. This configuration is used to deflect warm air along a floor. As can best be seen in FIGS. 4 through 6, the air-flow guiding plate 3 is disposed in generally vertically oriented relation in the first pair of opposed grooves 6. The air-flow from the register flows upwardly, as indicated by arrows 10. This configuration would be used to direct cool air upwardly. Air may also be directed at an angle, both upwardly and outwardly, by placing the air-flow guiding plate 3 in the second pair of grooves 8, which placement is not depicted in the Figures.

The air-flow guiding plate 3 is simply slid into and out of the first pair of grooves 6, the second pair of grooves 8, and the third pair of grooves 7, as desired, thereby providing for ready manual adjustment of the direction of air-flow from a forced air register.

Other modifications and alterations may be used in the design and manufacture of the apparatus of the present invention without departing from the spirit and scope of the accompanying claims.

What is claimed is:

1. A manually adjustable forced air-flow deflector comprising:

a back plate having a first end and a second end;

first and second end plates secured to the respective first and second ends of said back plate so as to project forwardly in generally transverse relation with respect to said back plate;

a movable air-flow guiding plate and retaining means therefor, said movable air-flow guiding plate being retained in selectively movable relation by said retaining means for movement between a first distinct position whereat said air-flow guiding plate is oriented in generally upstanding relation at the front of said end plates, a second distinct position whereat said air-flow guiding plate is oriented in angled relation, upwardly directed away from said back plate at a central portion of said end plates, and a third distinct position whereat said air-flow guiding plate is oriented in generally horizontal relation at the top of said end plates.

2. The forced air-flow deflector of claim 1, wherein said retaining means comprises a first pair of directly opposed grooves disposed one in each of said end plates, wherein each groove of said first pair of grooves is shaped and dimensioned to receive and retain one end of said air-flow guiding plate therein such that said air-flow guiding plate is disposed in generally upstanding relation, a second pair of directly opposed grooves disposed one in each of said end plates at a central portion thereof in angled relation, upwardly directed away from said back plate, wherein each groove of said second pair of grooves is shaped and dimensioned to receive and retain one end of said air-flow guiding plate therein such that said air-flow guiding plate is disposed at a central portion thereof in angled relation, upwardly directed away from said back plate, and a third pair of directly opposed grooves disposed one in each of said end plates at the top thereof in generally horizontal relation, wherein each groove of said third pair of grooves is shaped and dimensioned to receive and retain one end of said air-flow guiding plate therein in generally horizontally oriented relation.

3. The forced air-flow deflector of claim 2, wherein said first, second and third pair of grooves are recessed in said end plates.

4. The forced air-flow deflector of claim 3, wherein said first pair of directly opposed grooves is oriented in generally upstanding relation, said second pair of directly opposed grooves is oriented at a central portion of the respective end plates in angled relation, upwardly directed away from said back plate, and said third pair of directly opposed grooves is oriented in generally horizontally oriented relation.

5. The forced air-flow deflector of claim 4, wherein said air-flow guiding plate contacts said back plate when in place in either of said second pair of directly opposed grooves, and said third pair of directly opposed grooves.

6. The forced air-flow deflector of claim 5, wherein said first pair of directly opposed grooves are disposed in generally vertically oriented relation.

7. The forced air-flow deflector of claim 6, wherein said end plates are vertically oriented.

8. The forced air-flow deflector of claim 7, wherein said back plate is slanted upwardly and forwardly.

9. The forced air-flow deflector of claim 8, wherein said forced air-flow deflector is connected to a forced air-flow register by means of magnets.

10. The forced air-flow deflector of claim 9, wherein said forced air-flow deflector is made from a clear plastic material.

* * * * *